US005436815A

United States Patent [19]

Grooms et al.

[11] Patent Number: 5,436,815

[45] Date of Patent: Jul. 25, 1995

[54] FLUORESCENT UTILITY LIGHT

[76] Inventors: Michael P. Grooms; Pamela J. Grooms, both of 11903 Alpheus Ave., #C, Austin, Tex. 78759

[21] Appl. No.: 230,233

[22] Filed: Apr. 20, 1994

Related U.S. Application Data

[63] Continuation-in-part of Ser. No. 14,766, Nov. 2, 1993, Pat. No. D. 357,088.

[51] Int. Cl.[6] ..... F21S 5/00

[52] U.S. Cl. ..... 362/216; 362/220; 362/223; 362/260; 362/396; 362/397; 362/398; 362/430

[58] Field of Search ..... 362/216, 220, 222, 223, 362/260, 382, 396, 397, 398, 430, 432, 376, 378

[56] References Cited

U.S. PATENT DOCUMENTS

| | | | |
|---|---|---|---|
| 1,932,143 | 10/1933 | Piercy | 362/398 |
| 4,247,884 | 1/1981 | McJunkin, Jr. et al. | 362/164 |
| 4,262,327 | 4/1981 | Kovacik et al. | 362/223 |
| 4,658,337 | 4/1987 | Burke | 362/225 |
| 4,787,018 | 11/1988 | Poyer | 362/216 |
| 4,878,159 | 10/1989 | Blaisdell et al. | 362/222 |
| 4,958,267 | 9/1990 | Baake | 362/399 |

*Primary Examiner*—James C. Yeung
*Assistant Examiner*—Alan B. Cariaso
*Attorney, Agent, or Firm*—Richard C. Litman

[57] ABSTRACT

A portable fluorescent utility light makes advantageous use of one or more generally U-shaped fluorescent tubes by utilizing a transparent end cap or lens at the opposite end of the device from the electrical contact end. Thus, the present light may transmit light from the sides of the cylindrically shaped unit, and also from the end of the device. The relatively narrow end dimension, in comparison to the relatively long length of the cylinder, enables the device to be inserted into relatively small areas, in the manner of a conventional incandescent flashlight, but providing the additional benefit of light emission from the sides of the tube as well. Additional features may be provided, such as a refracting lens to focus the light emitted from the end of the tube, a variety of interchangeable temporary attachment devices, an internal reflector, and/or remotely locating the transformer or ballast and switch and sealing the unit to preclude explosive hazard from vapor ignition.

12 Claims, 3 Drawing Sheets

FLUORESCENT UTILITY LIGHT

This application is a continuation in part of U.S. patent application Ser. No. 29/014,766, filed on Nov. 2, 1993 now U.S. Pat. No. D. 357,088.

FIELD OF THE INVENTION

The present invention relates generally to lighting and illumination devices, and more specifically to a portable, fluorescent utility or drop light providing a field of illumination radiating from the sides and also from one end of the generally cylindrical light. Additional features, such as various means for the attachment of the light to various articles for convenience while working, are disclosed.

BACKGROUND OF THE INVENTION

Mechanics and other workers often have need for supplementary lighting in their work, either under a vehicle, within the engine compartment, or in other areas, e. g., the tail cone of an aircraft or other relatively dark and restricted area. Accordingly, various portable utility lights, generally called "trouble lights" or "drop lights," have been developed in the past. Generally, these lights have used incandescent light bulbs, which tend to be relatively fragile, in that a shock or jar (which occurs frequently to such lights in their usual working environment) can easily break the filament of the bulb, requiring replacement of the bulb.

More recently, utility lights using fluorescent tubes have been developed. As such lights utilize an electrically excited gas within the tube, the problem of broken filaments is eliminated. However, such fluorescent bulbs are generally tubular in shape, which results in utility lights generally conforming to a similar shape. As the opposite ends of the fluorescent tubes are equipped with electrical connectors, the ends of the housing for such tubes is opaque, due to the need to provide electrical connection and structural support for the tube as well as to provide a convenient means to attach the light to another structure in order to free the hands of the mechanic or worker.

This results in the light transmitted from the device being restricted to a generally radial output from the fluorescent tube and its housing, with no illumination provided from either end of the tube or housing. Oftentimes, it is difficult for the user of such a light to position the light so that the elongated tube is in a position to illuminate the area where light is needed. While the tube may be reoriented to provide light where needed, if the unlighted area is relatively small and narrow, the length of the tube cannot be oriented to provide light in the required area. At such times, a mechanic must resort to a relatively narrow light source, such as a flashlight or the like, which may or may not provide any attachment means to free the hands of the mechanic.

The need arises for a portable utility light which uses a fluorescent tube for greater durability and efficiency, but which is also capable of radiating light from one end of the generally cylindrical tube as well as conventionally from the sides. The light should provide for various optional attachment means for convenience, and may also optionally provide for the focus of light radiating from one end of the apparatus in order to intensify such light. The light should also provide a safe and hazard free source of illumination, with sealed and/or remotely located switch and power supply.

DESCRIPTION OF THE PRIOR ART

U.S. Pat. No. 1,932,143 issued to Earl R. Piercy on Oct. 24, 1933 discloses a Permanent Magnet Support For Lamps comprising a collar attachable to the base of a lamp, with a lockable swivel extending therefrom and a magnet extending from the swivel. While the present invention also makes use of a magnet as one attachment means, the illumination device itself and arrangement of components and function bear no resemblance to the Piercy device.

U.S. Pat. No. 4,247,884 issued to H. P. McJunkin, Jr. et al. on Jan. 27, 1981 discloses a Fluorescent Mine Lighting Fixture utilizing a fluorescent tube, as the title indicates. The tube is secured in a protective cage in a flexible mounting, thus allowing the light to be bolted to an uneven surface without distorting the fluorescent tube. The end caps provided appear to be opaque, in keeping with the arrangement of the fluorescent tube used in the device, and the mounting means is permanent, unlike the present invention.

U.S. Pat. No. 4,262,327 issued to James W. Kovacik et al. on Apr. 14, 1981 discloses a Portable Fluorescent Tube configured as a drop light or trouble light. Improved end socket construction is noted, but the end sockets are opaque. The switch and electrical connector at one end, and the temporary attachment means at the opposite end, result in both ends being completely blocked for the transmission of light, unlike the present invention.

U.S. Pat. No. 4,658,337 issued to Lawrence J. Burke on Apr. 14, 1987 discloses a Portable Fluorescent Lighting Device comprising a folding stand or frame into which fluorescent tubes may be installed. The lower ends of the tubes appear to be held in place by standard installation brackets, while the upper ends are blocked by an end plate. Hence, no light can be transmitted from the ends of the tubes. While a transparent cover is disclosed, the cover is conventionally disposed along the cylindrical sides of the tube rather than covering the tube ends.

Finally, U.S. Pat. No. 4,958,267 issued to Karl A. Baake on Sep. 18, 1990 discloses a Portable Lamp using a generally U-shaped fluorescent tube, as does the present invention. However, the Baake device fails to take advantage of the light emitting capabilities of such a U-shaped tube, and places the temporary attachment means for the light conventionally at one end of the tube, opposite the power cord attachment, thereby blocking any light output from the end of the fluorescent tube.

None of the above noted patents, taken either singly or in combination, are seen to disclose the specific arrangement of concepts disclosed by the present invention.

SUMMARY OF THE INVENTION

By the present invention, an improved fluorescent utility light is disclosed.

Accordingly, one of the objects of the present invention is to provide an improved fluorescent utility light which utilizes at least one generally U-shaped fluorescent tube, and which provides a transparent lens at one end of the tube in order to take advantage of the light emitting properties of such a U-shaped tube.

Another of the objects of the present invention is to provide an improved fluorescent utility light which end lens may be either flat, to provide relatively broad radiation of light from the end of the tube, or which may be curved to refract and focus the light emitted from the end of the tube to provide more intense illumination of a relatively small area.

Yet another of the objects of the present invention is to provide an improved fluorescent utility light which may use two generally U-shaped fluorescent tubes and which includes a single mounting base and socket adapted for such plural tubes.

Still another of the objects of the present invention is to provide an improved fluorescent utility light which power transformer and switch are located in series along the power cord, remotely from the light itself, and which light, transformer, switch, and/or other components are well sealed in order to preclude inadvertent ignition of any ambient vapors.

A further object of the present invention is to provide an improved fluorescent utility light which may include a variety of temporary attachment means, such as a magnet, suction cup, clamp, or hook, disposed adjacent the electrical power receiving end of the device, in order to preclude blockage of any light output.

An additional object of the present invention is to provide an improved fluorescent utility light in which such temporary attachment means are quickly and easily temporarily installable and removable from the light.

A final object of the present invention is to provide an improved fluorescent utility light for the purposes described which is inexpensive, dependable and fully effective in accomplishing its intended purpose.

With these and other objects in view which will more readily appear as the nature of the invention is better understood, the invention consists in the novel combination and arrangement of parts hereinafter more fully described, illustrated and claimed with reference being made to the attached drawings.

BRIEF DESCRIPTION OF THE DRAWINGS

Similar reference characters denote corresponding features consistently throughout the figures of the attached drawings.

DETAILED DESCRIPTION OF THE PREFERRED EMBODIMENT

Figure 1:
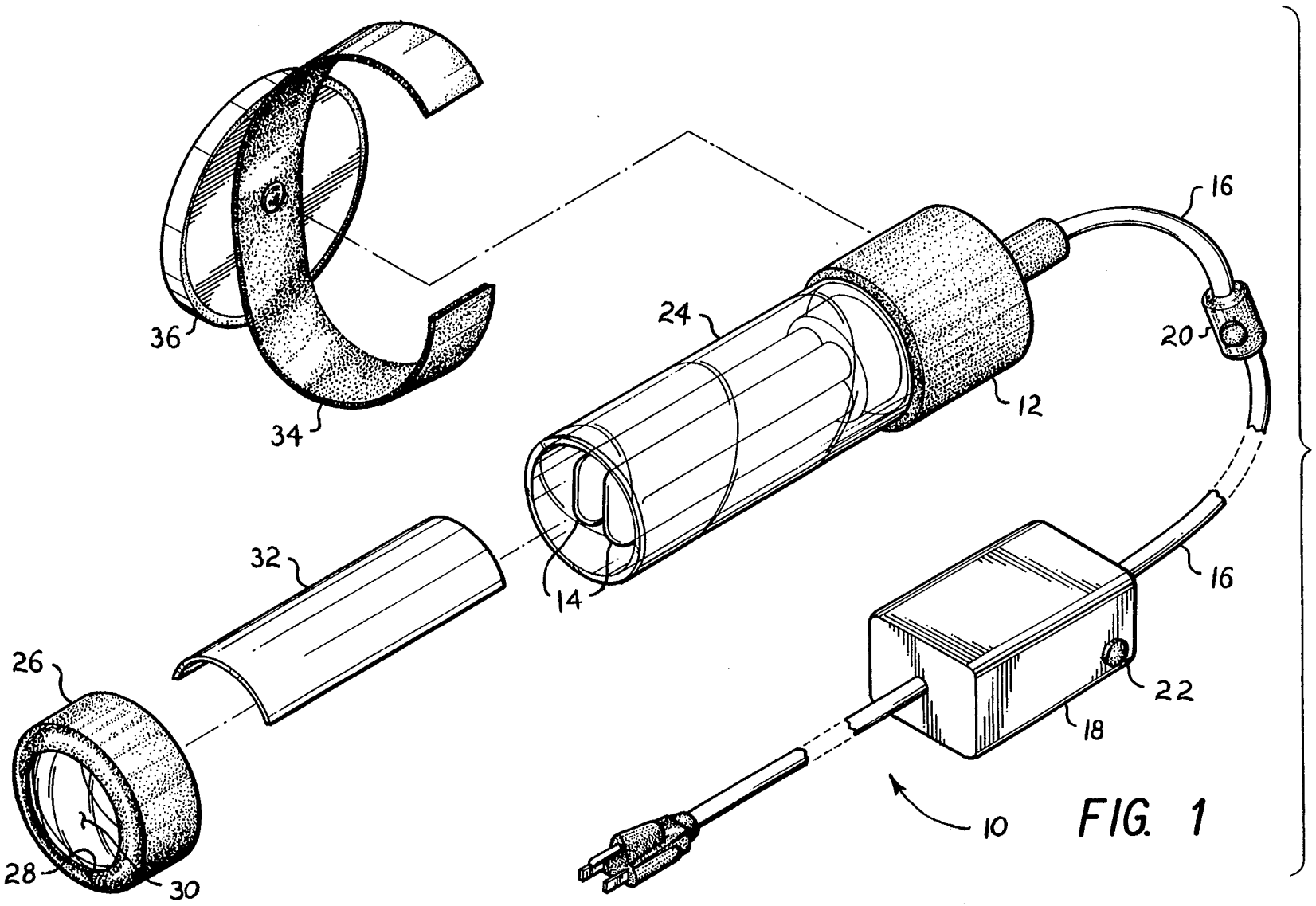
FIG. 1 is an exploded perspective view of the fluorescent utility light of the present invention, showing its various components and their relationship and one removable temporary attachment means.

Referring now particularly to FIG. 1 of the drawings, the present invention will be seen to relate to a portable fluorescent utility light 10 for use by mechanics and other persons requiring portable, temporary lighting for use in poorly lighted quarters. The utility light 10 includes a base portion 12 preferably of a resilient plastic or elastomer material for sealing the device (the interior details of which are disclosed in FIG. 3), which provides for the physical and electrical connection of a generally U-shaped fluorescent tube or tubes 14 thereto. The base portion 12 also serves as a hand grip and securing point for various devices providing for the attachment of the light to other articles.

An electrical cord 16 extends from the base portion 12 to provide for electrical connection to an electrical power source, e.g., 115 volt ac outlet or other compatible power source. The power cord 16 preferably includes a transformer or ballast 18 to provide the proper voltage to the fluorescent tubes 14, and an on/off switch 20, each of which is preferably remotely located from the base portion 12 and fluorescent tubes 14 secured thereto. The advantages of such remote location for the transformer 18 and switch 20 are that possible electrical arcing or heat from such components are located away from the light itself, which may be used in areas of volatile vapors (gasoline, etc.). The remote location of such components provides additional operational safety for the present light. Further safety may be provided by means of a sealed case for the transformer 18, as shown (with the exception of a fuse 22, circuit breaker, ground fault interrupter, or the like) and a sealed resilient cover as shown around and over the switch 20. The remote location of the relatively heavy transformer 18 also reduces the weight which would otherwise be required to be carried by a user of the present light if it were located with the base portion 12. The switch 20 may be located relatively close to the base portion 12 (or alternatively on the base portion 12, if desired), for convenience in turning the device on and off.

Extending from the base portion 12 and surrounding the U-shaped fluorescent tube or tubes 14, is a generally cylindrical transparent cover 24 of a polycarbonate material (e.g., Lexan, tm; other materials may be used), providing for the transmission of light radially from the sides of the tube(s) 14, in the manner of conventional fluorescent drop lights known in the art. The base end of the cover 24 is seated within the resilient base portion 12 to provide a good seal therewith. A generally toroidally shaped end cap 26, also preferably formed of a resilient material, is provided to fit closely over the opposite end of the cover 24 from the base end and to seal that end of the cover 24.

Figure 3:
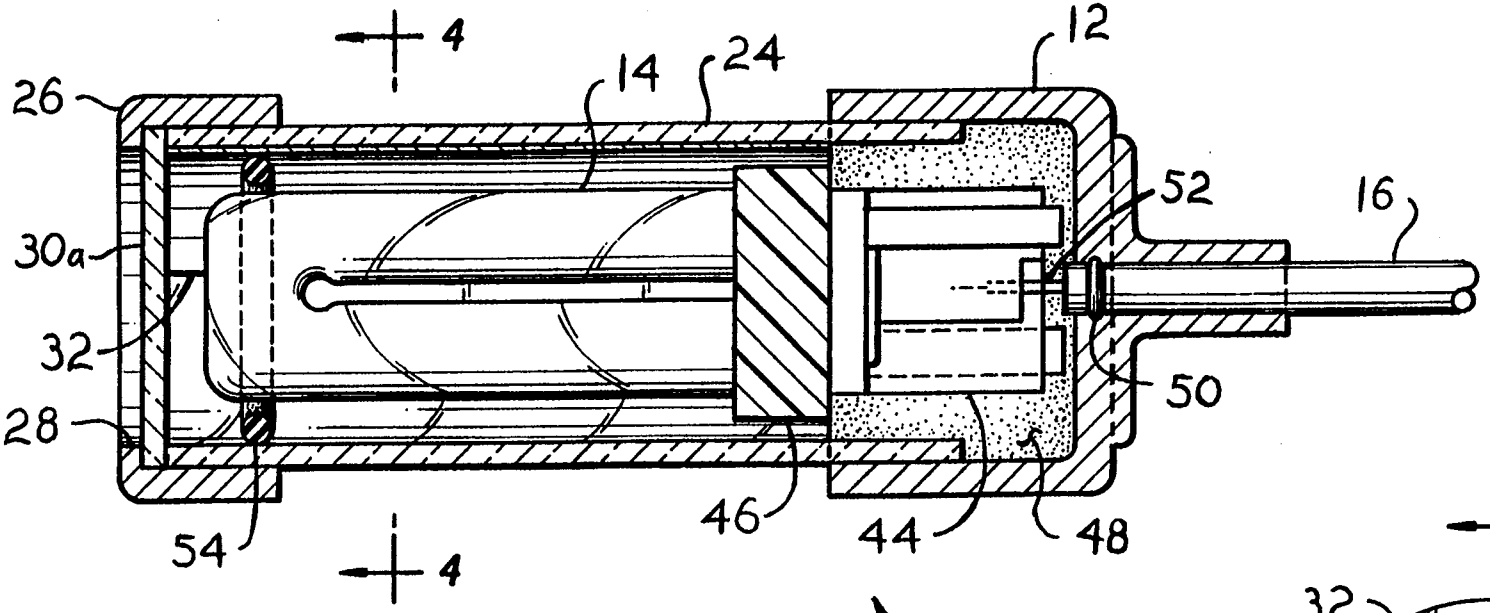
FIG. 3 is a side view in section taken along line 3—3 of FIG. 4, showing the internal configuration of the present light.

The end cap 26 includes a central opening 28 therein, which holds a transparent lens 30 therein. As the U-shaped fluorescent tube(s) 14 used with the present invention include all of their electrical connectors at the adjacent ends of the tube(s), as shown in FIG. 3, the bend(s) in the tube(s) 14 defining the end(s) opposite the electrical connector ends of the tube(s) transmit light equally as well as the straight portions of the tube(s). The present invention makes advantageous use of this light transmission capability of the U-shaped bend(s) of the tube(s) by providing such a clear or transparent lens 30 adjacent the end(s) of the tube(s) and sealed within the central opening 28 of the end cap 26. Thus, the present utility light 10 is capable of transmitting light not only from the sides of the cylindrical cover 24, but also from the end of the device by means of the lens 30. In many cases, a conventional cylindrical fluorescent drop light is incapable of illuminating a relatively small area, due to the cumbersome length of the side of the tube from which the light is emitted. The present utility light 10 responds to such need by emitting light from the relatively small end of the tube also, so the device may be aimed into a tight area for the illumination thereof, in the manner of a flashlight. However, the present utility light 10 provides several advantages over such a flashlight, in that (1) a separate light is no longer needed, (2) various attachment means are provided with the present light to enable the user to secure it temporarily to another structure for hands free operation, and (3) the present light puts out far more light than a battery powered flashlight.

It will be noted that the lens 30 of FIG. 1 has a lenticular shape or convex curvature, in order to refract the light passing therethrough and focus the light to a greater degree for greater light intensity in a smaller area. Alternatively, a flat lens 30*a* (shown in cross section in FIG. 3) may be provided within the opening 28 of the end cap 26, if desired, to protect and seal the end(s) of the tube(s) 14 and provide wider light projection. The radiation of light from the cylindrical cover 24 may also be focused to some extent by providing an arcuate reflector 32 (thin curved sheet of polished aluminum or the like) within the cover 24, to reflect the light back to one side of the cover 24 and thereby provide a narrower but brighter light output for the present utility light 10. The reflector 32 may be inserted or removed from within the cover 24 by removing the end cap 26 to provide access thereto, in the manner used to change fluorescent tube(s) 14 when necessary.

The present utility light 10 provides for several alternative means of temporarily securing the device to another object or structure; one of these means is shown in FIG. 1. In each case, a band or openable strap 34 of hook and loop fastening material (e.g., Velcro, tm) is provided, which may be secured about the base portion 12 of the utility light 10. The resilient nature of the base portion 12 tends to preclude slippage of the closed band 34 of fastening material. Moreover, the non-light transmitting nature of the base portion of the present light provides an ideal location for the attachment of other opaque and/or non-light transmitting articles, as light transmitted from the remainder of the device is not blocked thereby.

In FIG. 1, a disc or otherwise shaped magnetic material 36 is riveted or otherwise secured to the hook and loop band 34. When the band 34 is secured about the base portion 12 of the utility light 10, the light may be temporarily secured to any appropriate ferrous metal structure as desired. This magnetic means of temporarily securing the present light to a structure of ferrous metal is particularly helpful in the automotive field, as virtually all motor vehicles include an undercarriage, chassis or floor pan formed of such ferrous metal material, where the present light will be most valuable in working under the vehicle.

Figure 2A:
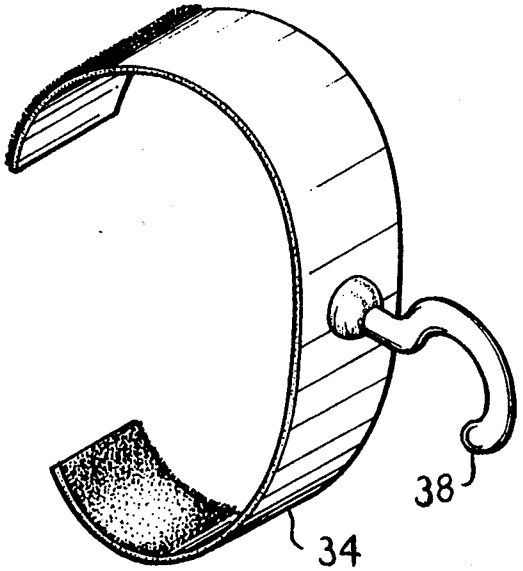
FIG. 2A is a perspective view of an alternative hook attachment means for the present light.

FIG. 2A discloses an alternative means for temporarily securing the present utility light 10 to another structure. In the event that no ferrous metal attachment area is available or convenient, a hook and loop band 34 may be provided with a hook 38 thereon, and secured to the base portion 12 of the present light in the manner described above for the magnetic attachment means 36. Such a hook 38 is especially useful in areas where there are struts, rods, cables, lightening holes, etc. which such a hook 38 may engage.

Figure 2B:
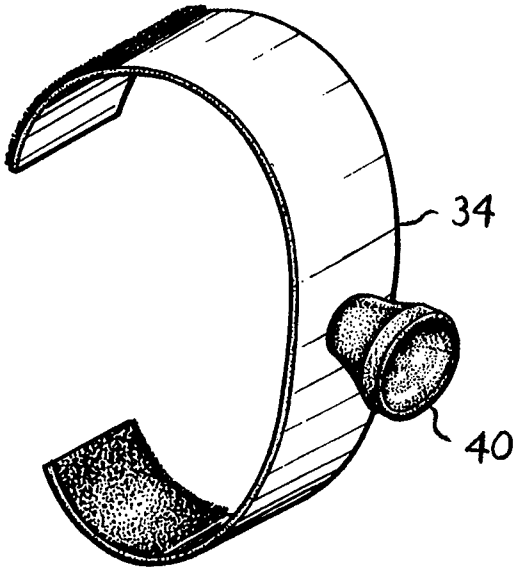
FIG. 2B is a perspective view of an alternative suction cup attachment means for the present light.

In FIG. 2B, a further temporary attachment alternative is provided by a suction cup 40 extending from the band 34. Such a suction cup attachment means is particularly useful where relatively large, unbroken and flat areas of non-ferrous metal, plastic, etc. are located, and where there are no protuberances or elements to which a hook 38 may be secured.

Figure 2C:
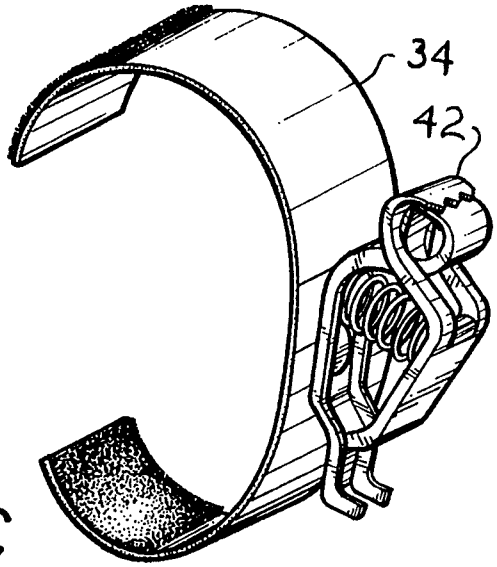
FIG. 2C is a perspective view of an alternative clamp attachment means for the present light.

Yet another alternative temporary attachment means is disclosed in FIG. 2C, in which a clamp 42 is shown attached to the hook and loop fastening band or strap 34. Such a clamp 42 is particularly useful in areas where an exposed thin edge of a sheet of material is exposed, but where there are no holes, passages, or elongate structure to which a hook may be secured, nor any flat expanses of smooth sheet material to provide for the adherence of a suction cup. Other temporary attachment devices may also be used in combination with the present utility light 10, if desired.

Figure 4:
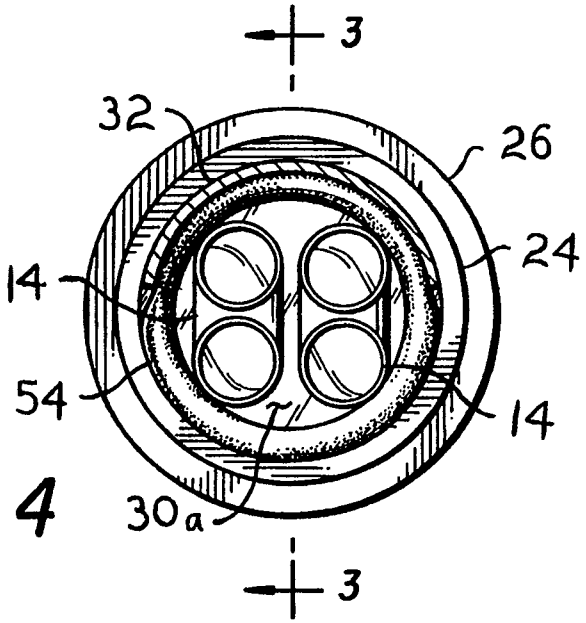
FIG. 4 is an end view in section along line 4—4 of FIG. 3, showing further internal details.

FIGS. 3 and 4 respectively disclose side and end views in section of the present utility light 10, showing the internal structure. In FIG. 3, the installation details of the fluorescent tube base or socket 44, as well as other details, is shown. The socket 44 provides for the physical and electrical connection of the fluorescent tube(s) 14 within the light 10. Such tubes 14 include a tube base 46, from which a plurality of pins (not shown) extend to plug conventionally into an appropriate electrical socket (e. g., socket 44). Such sockets 44 adapted to U-shaped fluorescent tubes 14 may provide for plural tubes 14, as shown in FIGS. 1 and 4, or alternatively may provide for a single tube 14, as shown in the cross section view of FIG. 3. The tube base 46 is adapted to mate with the appropriate socket 44, depending upon the number of tubes 14 provided.

The socket 44 is in turn encapsulated within an electrically insulating, preferably resilient material 48; a silicone sealant has been found to work well for such purposes. The socket 44 and encapsulating material 48 are in turn covered by the resilient base portion 12, which also captures the base end of the transparent cover 24. The result is an electrical base which provides excellent resistance not only to electrical shock hazard, but also to damage to the utility light 10 due to physical shock (e. g., inadvertent dropping, etc.). The electrical power cord 16 is also secured within the base portion 12, by a retaining ring 50 or the like, in order to preclude its electrical leads 52 from pulling out of the base portion 12 and/or the socket 44.

Further durability for the present utility light 10 is provided by an O-ring 54 or the like of a resilient material (e.g., rubber, etc.) secured around the tube(s) 14, adjacent their curved End(s) and the lens 30/30*a*. The O-ring 54 serves to limit movement of the cantilevered curved end(s) of the tube(s) 14 within the transparent cover 24, thereby reducing physical shock to the tube(s) 14 when the utility light 10 is handled, and also serves to retain the adjacent end of the reflector 32 when installed to prevent contact between the reflector 32 and the tube(s) 14. FIG. 4, which discloses an end view in section of the present utility light 10 through line 4—4 of FIG. 3 of the drawings, provides an additional view of the O-ring 54, as well as the concentric arrangement of the end cap 26, transparent cover 24, arcuate reflector 32, U-shaped fluorescent tubes 14, and lens 30*a*.

The present fluorescent utility light 10 will be seen to provide an advance in the field of such lights, by providing light radiation not only from the sides of the fluorescent tube(s) 14 through the sides of the cylindrical transparent cover 24, but also from the curved ends of the U-shaped fluorescent tube(s) 14 and the adjacent flat or curved lens 30*a* or 30, held in place by the resilient end cap 26. The present light may thus be used in the manner of conventional cylindrical or tubular drop lights and the like, being temporarily secured in place by means of one of the temporary attachments 36 through 42 disclosed in FIGS. 1 through 2C respectively. Further, the additional versatility provided by the light output from the end of the cylinder by the lens 30 or 30*a*, enables the present utility light 10 to be used in the manner of a flashlight, but provides considerably more light output due to the efficiency of the fluorescent tube(s) 14 and the higher power provided by 115 volt ac electrical power, as opposed to flashlight batteries. The temporary attachment means discussed above enable the present light to be secured temporarily to virtually any structure with the lens 30 or 30*a* oriented as desired, to provide light for virtually any working conditions.

It is to be understood that the present invention is not limited to the sole embodiment described above, but encompasses any and all embodiments within the scope of the following claims.

We claim:

1. A portable fluorescent utility light comprising:

a base portion adapted for the physical and electrical installation of at least one generally U-shaped fluorescent tube and having said at least one generally U-shaped fluorescent tube installed therein;

a power receiving end having a power cord extending therefrom and enclosing said base portion; and an opposite removable, toroidally shaped end cap, with a generally cylindrical transparent cover extending between said power receiving end and said end cap and surrounding said at least one fluorescent tube, with said end cap having an open center with a transparent lens installed therein, said transparent lens having a lenticular shape and providing for the refraction and focusing of light passing through said transparent lens; and said at least one generally U-shaped fluorescent tube includes an arcuate bend therein, with said arcuate bend being disposed adjacent said transparent lens, whereby said fluorescent utility light provides illumination radiating from said generally cylindrical transparent cover and further illumination radiating from said transparent lens of said end cap.

2. The fluorescent utility light of claim 1 including: an arcuate reflector installed within said transparent cover.

3. The fluorescent utility light of claim 1, further including:

a resilient o-ring disposed about said at least one fluorescent tube and adjacent said arcuate bend of said at least one fluorescent tube and sandwiched between said at least one fluorescent tube and said transparent cover, whereby said arcuate bend of said at least one fluorescent tube is supported by said o-ring and is precluded from movement within said transparent cover.

4. The fluorescent utility light of claim 1 wherein:

said utility light includes two generally U-shaped fluorescent tubes therein, with said base portion being adapted for the physical and electrical installation of said two fluorescent tubes.

5. The fluorescent utility light of claim 1 wherein:

said power cord includes at least a transformer and power switch installed in series therewith, with said transformer and said power switch being remotely located from said base portion of said light.

6. The fluorescent utility light of claim 5 wherein:

said base portion, said end cap, and said transparent cover therebetween are mutually sealed together, and said transformer and said power switch are each sealed to preclude ignition of ambient explosive vapors.

7. The fluorescent utility light of claim 1 including:

means providing for the attachment of said utility light to another object.

8. The fluorescent utility light of claim 7 wherein:

said means providing for the attachment of said utility light to another object is adapted to be temporarily and removably secured to said base portion of said utility light by means of a band of hook and loop fastening material.

9. The fluorescent utility light of claim 8 wherein:

said means providing for the attachment of said utility light to another object comprises a magnet.

10. The fluorescent utility light of claim 8 wherein:

said means providing for the attachment of said utility light to another object comprises a hook.

11. The fluorescent utility light of claim 8 wherein:

said means providing for the attachment of said utility light to another object comprises a suction cup.

12. The fluorescent utility light of claim 8 wherein:

said means providing for the attachment of said utility light to another object comprises a clamp.

* * * * *